US006428057B1

(12) United States Patent
Reise

(10) Patent No.: US 6,428,057 B1
(45) Date of Patent: Aug. 6, 2002

(54) MUZZLE DOOR LATCH FOR STATIC AND DYNAMIC CONDITIONS

(75) Inventor: David G. Reise, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 59 days.

(21) Appl. No.: 09/678,879

(22) Filed: Oct. 4, 2000

(51) Int. Cl.[7] ..... E05C 1/00

(52) U.S. Cl. ..... 292/32; 292/163; 292/164; 277/637

(58) Field of Search ..... 292/163, 33, 164, 292/32; 220/326, 323; 277/630, 637, 640, 641, 616

(56) References Cited

U.S. PATENT DOCUMENTS 884,481 A * 4/1908 Glaus
1,194,636 A * 8/1916 Joy
2,494,956 A * 1/1950 Mendelsohn
6,336,641 B1 * 1/2002 Williams ..... 277/637

* cited by examiner

*Primary Examiner*—Teri Pham Luu
(74) *Attorney, Agent, or Firm*—Michael J. McGowan; James M. Kasischke; Prithvi C. Lall

(57) ABSTRACT

A muzzle door latch, or attachment mechanism, incorporates spring-loaded plungers acting within concave surfaces to provide additional resistance to vibration. The door, or cap, has an elastomeric seal about its outer circumference, which fits snugly within the muzzle. Diametrically opposed guides are attached to the outer side of the cap and extend radially past the outer edge of the muzzle. A plate is attached to the exterior of the muzzle, corresponding to each guide, and each plate extends slightly beyond the end of the muzzle. A roller on each guide engages the outer surface of the plate when the cap is positioned within the muzzle. The plates have a concave indentation on their inner surface, and a spring-loaded plunger on each guide is biased against the concave surface.

8 Claims, 2 Drawing Sheets

MUZZLE DOOR LATCH FOR STATIC AND DYNAMIC CONDITIONS

STATEMENT OF GOVERMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to door latches, and more particularly to a door latch for retaining a cap on a muzzle during static and dynamic loading.

(2) Description of the Prior Art

In firing systems for various projectiles, muzzle doors, or caps, are used to prevent intrusion of foreign objects into the muzzle prior to firing of the projectile. The design of the muzzle door latch, i.e., its attachment to the muzzle, is such that the cap can easily detach from the muzzle upon firing the projectile. The caps are further designed to fall cleanly away from the muzzle upon detachment so as to provide a clear trajectory for the projectile.

FIG. 1 shows a prior art muzzle cap 10 in cross section. It is noted that the cap assembly components are generally symmetrical about the centerline of muzzle 12. Thus, reference numerals may be indicated for only one of such symmetrical components. Cap 10 is sized to fit within muzzle 12 with a slight clearance 14 between cap 10 and muzzle wall 12*a*. Cap 10 includes a circumferential groove 10*a* about its edge 10*b* adjacent interior muzzle wall 12*a*. Elastomeric ring seal 16 is positioned in groove 10*a*, such that cap 10 is retained within muzzle 12 by friction between seal 16 and muzzle wall 12*a*. To ensure cap 10 exits muzzle 12 cleanly upon firing a projectile from muzzle 12, two roller guides 18 are attached to cap 10 in diametrically opposed relation by means of bolts 20. Each guide 18 is attached to front surface 10*c* of cap 10 and extends radially past the exterior 12*b* of muzzle 12. Pin 22 and roller 24 are attached to end 18*a* of guide 18, such that roller 24 is in a spaced apart relation with end 18*a*. Muzzle extension plate 26 is affixed to exterior 12*b* of muzzle 12 and extends slightly beyond end 12*c* of muzzle 12. When cap 10, with attached guide 18, is positioned into muzzle 12, roller 24 is seen to fit over plate 26, with plate 26 extending between roller 24 and end 18*a* of guide 18. Upon firing a projectile, the action of rollers 24 against plates 26 causes cap 10 to exit past end 12*c* of muzzle 12 without rotating within muzzle 12. This prevents jamming of cap 10 within muzzle 12 and allows cap 10 to fall cleanly away from muzzle 12. Additionally, rollers 24 assist in aligning cap 10 with muzzle 12 during insertion of cap 10 within muzzle 12. It can also be seen from FIG. 1 that guides 18 allow muzzle cap 10 to be inserted into muzzle 12 only until guides 18 contact muzzle end 12*c*, thus also ensuring proper positioning of cap 10 within muzzle 12.

However, the prior art configuration of FIG. 1 allows muzzle cap 10 to separate from muzzle 12 during vibrational loads. Seals 16 begin to wear with repeated insertion and detachment of cap 10. As only frictional forces between seal 16 and muzzle 12 hold cap 10 in place, wearing of seal 16 can cause cap 10 to loosen within muzzle 12. Shearing pins may be added between the cap and the muzzle such that the cap detaches at a predetermined load. However, installation of shearing pins requires additional operator training and involvement. Manual locking and unlocking of the cap to the muzzle would suffice to keep the cap within the muzzle. Such a design would require visual verification of the lock condition prior to a firing exercise. Further, each of these designs require the use of separate, small parts that may be misplaced or damaged during firing.

SUMMARY OF THE INVENTION

Accordingly, it is an object of the present invention to provide muzzle door latch that provides additional resistance to vibration.

Another object of the present invention is to provide a vibration resistant muzzle door latch that does not require retraining of personnel for installation.

Still another object of the present invention is to provide a muzzle door latch that is integral with current muzzle caps.

Other objects and advantages of the present invention will become more obvious hereinafter in the specification and drawings.

In accordance with the present invention, a muzzle door latch, or attachment mechanism, incorporates spring-loaded plungers acting within concave surfaces to provide additional resistance to vibration. The door, or cap, has an elastomeric seal about its outer circumference, which fits snugly within the muzzle. Diametrically opposed guides are attached to the outer side of the cap and extend radially past the circumference of the muzzle, thus allowing the cap to be inserted into the muzzle only until the guides meet the edge of the muzzle. A plate is attached to the exterior of the muzzle, corresponding to each guide, and each plate extends slightly beyond the end of the muzzle. Each guide has a roller at its end furthest away from the cap and attached to the guide so as to have a gap between the roller and exterior of the muzzle. The axis of the roller is oriented such that the roller is orthogonal to the axis of the muzzle and tangential to its corresponding plate surface. When the cap is positioned within the muzzle, the portions of the plates extending beyond the end of the muzzle fit within the gap and the rollers engage the outer surface of the plates. The portions of the plates extending beyond the muzzle are machined to have a concave indentation on their inner surface, i.e., the surface facing towards the interior of the muzzle. Each guide has a pocket formed in its surface facing the concave indentation. The spring-loaded plunger fits within the pocket and is biased in a direction against the concave surface. As the cap is being placed within the end of the muzzle, the plungers are depressed against the spring within the pocket while clearing the end of the plate. Once the cap is fully seated into the muzzle, i.e., when the guides contact the outer edge of the muzzle, the springs force the plungers into the concave indentation on the plate. Thus, even if the frictional force between the seal and the muzzle is diminished by wear, the plungers serve to hold the muzzle door, or cap, in place. As the cap installs in the same manner as prior art caps, personnel need not be retrained to install the cap. Further, the spring-loaded plunger is an integral part of the cap so there are no additional, or small parts that can be misplaced.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
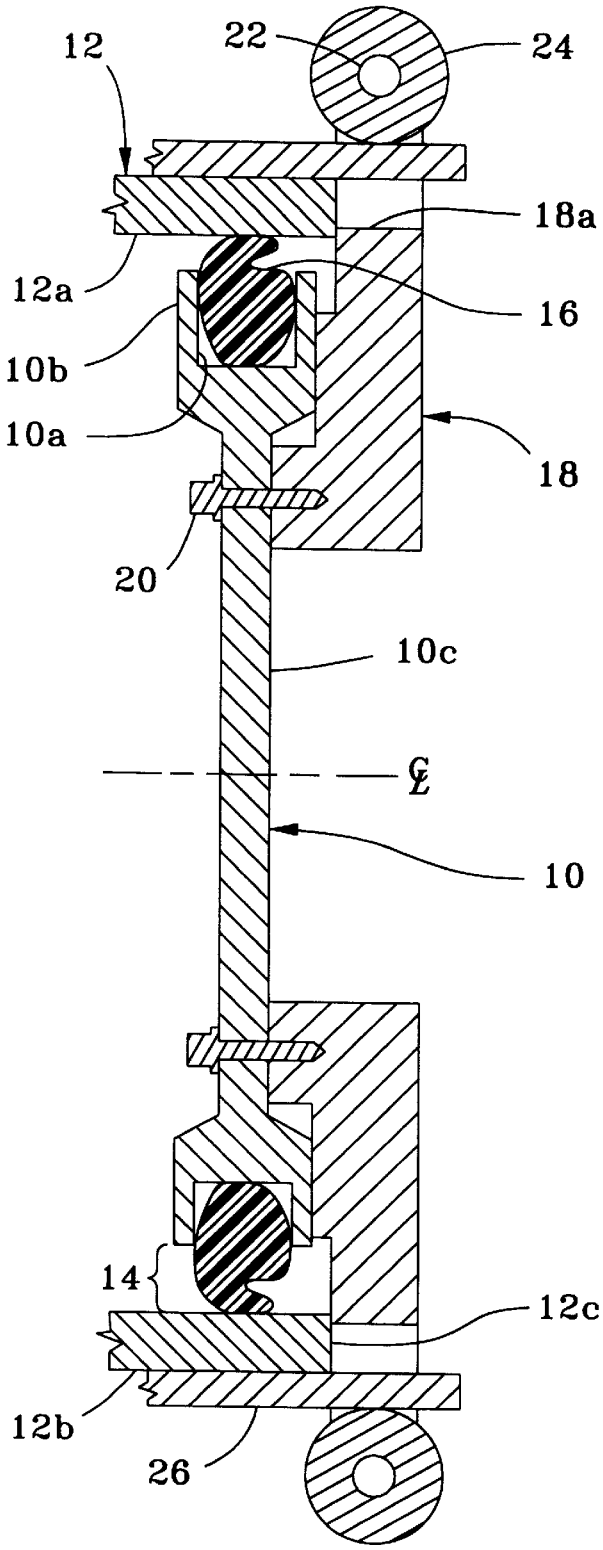
FIG. 1 (PRIOR ART)
FIG. 1 is a side sectional view of a prior art muzzle door and latching mechanism.
Figure 2:
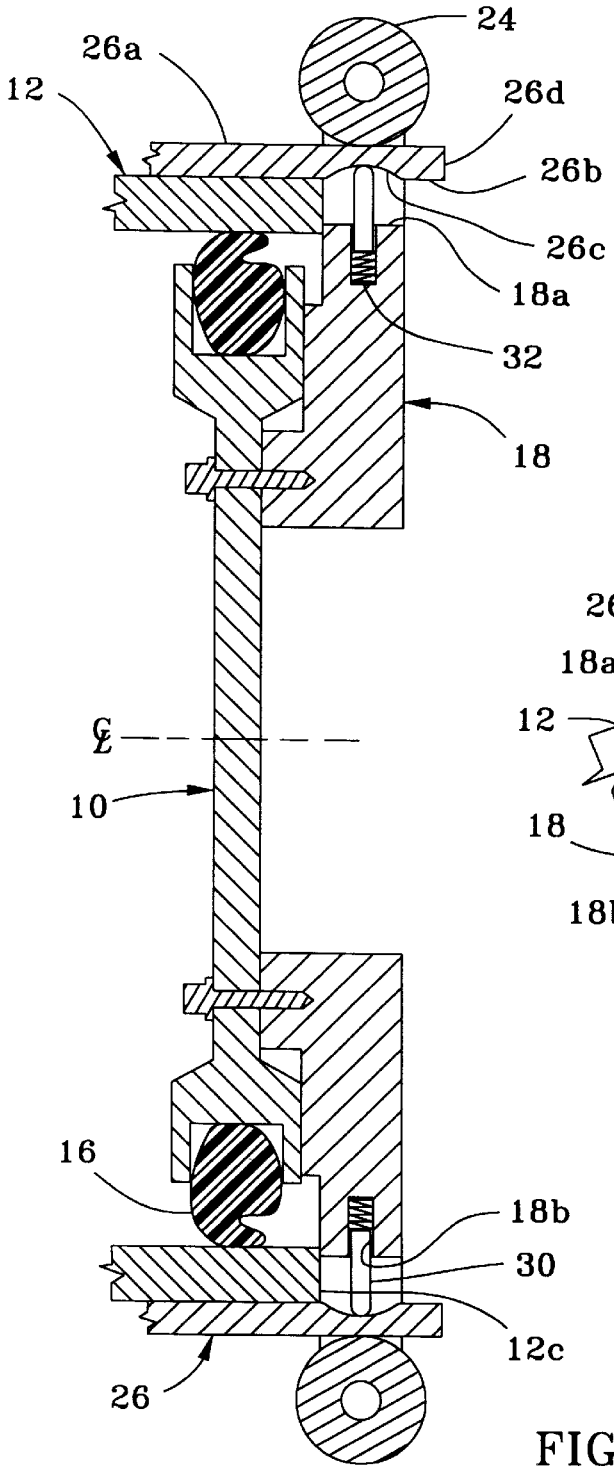
FIG. 2 is a side sectional view of a muzzle door and latching mechanism in accordance with the present invention.
Figure 3:
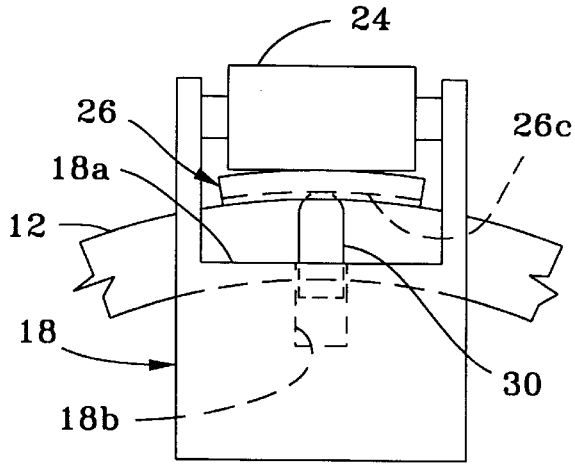
FIG. 3 is a partial front view of a muzzle door and latching mechanism in accordance with the present invention.

Referring now to FIGS. 2 and 3, there is shown a side sectional view and a partial front view of a muzzle door, or cap, incorporating the latching mechanism of the present invention. The current invention incorporates the features of the prior art muzzle door as previously described in FIG. 1, and these features are described in an abbreviated manner in relation to FIGS. 2 and 3. Cap 10 fits within muzzle 12 with elastomeric ring seal 16 forming a friction fit to retain cap 10 within muzzle 12. Rollers 24 on guides 18 engage the outer surfaces 26*a* of plates 26 to assist in aligning cap 10 with muzzle 12 and prevent rotation of cap 10 within muzzle 12. Guides 18 also prevent cap 10 from being positioned too far into muzzle 12. Each plate 26 extends beyond end 12*c* of muzzle 12, such that inner surface portion 26*b* of plate 26 is in opposing relation to end 18*a* of guide 18 when cap 10 is seated within muzzle 12. Concave depression 26*c* is machined in surface portion 26*b*. Pocket 18*b* is provided in end 18*a* of guide 18 so as to retain plunger 30. Plunger 30 is biased away from end 18*a* and towards depression 26*c* by means such as spring 32. When the cap and guide assembly is being positioned onto muzzle 12, plunger 30 contacts front edge 26*d* of plate 26 and is subsequently forced further into pocket 18*b*. As cap 10 enters muzzle 12, end 18*a* aligns with depression 26*c* and the spring bias of plunger 30 forces plunger 30 part way out of pocket 18*b* and into contact with depression 26*c*. The spring bias of plunger 30 is made sufficient to prevent cap 10 from detaching from muzzle 12 under anticipated vibrational loads, yet not so strong as to interfere with a projectile being fired from muzzle 12. In order to avoid interference with projectile firing should the plungers be iced or jammed within the pockets, the plungers can be fabricated of a material, such as an acetyl copolymer, which will shear at the appropriate force.

The invention thus described provides a positive latching means for maintaining a muzzle door within a muzzle. The plungers continue to provide positive latching even when the frictional force between the seal and the muzzle is diminished by wear. As can be readily seen, the cap of the present invention installs in the same manner as prior art caps, only requiring slightly more force to overcome the spring bias of the plungers when pushing the cap into the muzzle. Thus, no retraining of personnel is needed to use the cap of the present invention. As the plunger is retained within its pocket, there are no additional small parts, such as shear pins or locks, which could be misplaced. It is also noted that extension and retraction of plungers in opposing guides can accommodate some movement of the door within the muzzle during vibrational loading.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A latch for retaining a door within an end of a muzzle, the latch comprising at least one plunger biased in a radial direction away from a longitudinal axis of the muzzle, the plunger engaging a depression within a plate affixed to the muzzle, the depression being within a portion of the plate extending beyond the end of the muzzle, wherein the plunger is fabricated of a material that will shear when subjected to a force of a projectile being ejected from the muzzle.

2. The latch of claim 1, wherein each at least one plunger is paired with a diametrically opposed plunger.

3. The latch of claim 2, wherein each plunger is retained within a pocket in an end of a roller guide assembly attached to the door, the end being in an opposed spaced apart relation to the depression.

4. The latch of claim 3, further comprising a spring within the pocket to bias the plunger against the depression.

5. The latch of claim 1, wherein the plunger is biased against the depression by means of a spring.

6. The latch of claim 1, wherein each plunger is retained within a pocket in an end of a roller guide assembly attached to the door, the end being in an opposed spaced apart relation to the depression.

7. The latch of claim 1, wherein the material is an acetyl copolymer.

8. A muzzle door assembly for capping an end of a cylindrical muzzle, the assembly comprising:

a circular door having a seal about its circumference, the seal mating with an interior surface of the muzzle;

at least two diametrically opposed guides affixed to a surface of the door exterior the muzzle, the guides extending radially past a circumference of the door, the guides contacting the end of the muzzle to prevent the door from further insertion into the muzzle;

a plate corresponding with each guide, the plate fixed longitudinally to an exterior surface of the muzzle and having a portion extending beyond the end of the muzzle;

a pocket formed within an end of each guide, the pocket being in a spaced apart relation to the plate portion; and a plunger movably retained within each pocket, the plunger biased against a depression within the plate portion to further retain the door within the muzzle, said plunger being fabricated of a material that will shear when subjected to a force of a projectile being ejected from the muzzle.

* * * * *